US008004472B2

(12) United States Patent
Su

(10) Patent No.: US 8,004,472 B2
(45) Date of Patent: Aug. 23, 2011

(54) ANTENNA STABILIZING APPARATUS

(76) Inventor: Hsin-Chi Su, Taipei (TW)

( * ) Notice: Subject to any disclaimer, the term of this patent is extended or adjusted under 35 U.S.C. 154(b) by 248 days.

(21) Appl. No.: 12/464,695

(22) Filed: May 12, 2009

(65) Prior Publication Data

US 2009/0284437 A1 Nov. 19, 2009

(30) Foreign Application Priority Data

May 16, 2008 (TW) ..... 97208623 U

(51) Int. Cl.
*H01Q 1/34* (2006.01)

(52) U.S. Cl. ..... 343/709; 343/872

(58) Field of Classification Search ..... 343/709, 343/765, 872, 878
See application file for complete search history.

(56) References Cited

U.S. PATENT DOCUMENTS 4,609,083 A * 9/1986 Stuhler ..... 188/378
4,920,349 A * 4/1990 Le Gall ..... 343/709
5,922,039 A * 7/1999 Welch et al. ..... 701/116
7,382,327 B2 * 6/2008 Nelson ..... 343/709
7,683,625 B2 * 3/2010 Milne et al. ..... 324/365

* cited by examiner

*Primary Examiner* — Tan Ho
(74) *Attorney, Agent, or Firm* — Wang Law Firm, Inc.; Li K. Wang

(57) ABSTRACT

An antenna stabilizing apparatus for use on a marine vessel comprises a base body, a housing, a carrier, and a limiting member. The housing is mounted on a top of the base body and internally defines a receiving space. The carrier has at least one antenna carried thereon, and is connected to the house via a hanging member to suspend in the receiving space. The limiting member interconnects the carrier and a bottom of the housing to each other and limits a displacement range allowable for the carrier. With these arrangements, the antenna stabilizing apparatus is able to minimize the adverse influence of the rolling and pitching marine vessel on the signal receiving and transmitting via the antenna mounted on the marine vessel. Therefore, the marine vessel can navigate the sea more safely and stable wireless signal transmission via the antenna mounted on the marine vessel can be ensured.

32 Claims, 6 Drawing Sheets

ANTENNA STABILIZING APPARATUS

FIELD OF THE INVENTION

The present invention relates to an antenna stabilizing apparatus, and more particularly to an antenna stabilizing apparatus for use on a marine vessel to minimize the influence of a rolling and pitching marine vessel on the quality of wireless signal transmission.

BACKGROUND OF THE INVENTION

General marine vessels, including various boats and ships, are subjected to rolling and pitching when navigating the sea with surges and strong wind. At this point, the antennas fixedly mounted on the marine vessels will sway along with the rolling and pitching marine vessels to cause continuous changes in the range of wireless signal transmission via the antennas. This condition has adverse influence on the quality of wireless signal transmission among neighboring vessels via the antennas, and results in narrowed wireless signal range as well as unstable signal transmission quality, errors in information generated by on-board communication apparatus and other related precision instruments. In worse conditions, the on-board communication apparatus and precision instruments might become useless under the server navigation condition on the sea. Besides, the antennas on the marine vessels are frequently exposed to sunlight, rainwater, and corrosion by sea wind to result in short circuit or other safety-related problems of the apparatus and devices connected to the antennas. In the event the apparatus and devices connected to the antennas are damaged, a large amount of labor, time and money is required to repair them.

SUMMARY OF THE INVENTION

It is therefore a primary object of the present invention to provide an antenna stabilizing apparatus, which utilizes the gravity action for an antenna mounted on a marine vessel to always locate at a position perpendicular to the earth core, so as to minimize the degree of sway of the antenna due to the rolling and pitching of the marine vessel and accordingly ensure stable signal receiving and transmitting ranges by the antenna on the marine vessel.

To achieve the above and other objects, the antenna stabilizing apparatus for use on a marine vessel according to the present invention comprises a base body, a housing, a carrier, and a limiting member. The housing is mounted on a top of the base body and internally defines a receiving space. The carrier has at least one antenna carried thereon, and is suspended in the receiving space via a hanging member. The limiting member interconnects the carrier and a bottom of the housing to each other, so as to limit a displacement range allowable for the carrier.

According to another object of the present invention, the antenna stabilizing apparatus for use on a marine vessel can minimize the influence of a repeatedly tilting marine vessel on an antenna mounted thereon. The antenna stabilizing apparatus comprises a base body, a housing, a carrier, a supporting member, and a suspended member. The housing is located over the base body and internally defines a receiving space. The carrier has a plurality of antennas carried thereon and is located in the receiving space. The supporting member is located below the carrier and concentrically located between the base body and the suspended member, and comprises a first axle rod, a second axle rod, and a rotating body. The first axle rod connects the rotating body to the base body, so that the rotating body is rotatable about the first axle rod relative to the base body. The second axle rod connects the rotating body to the suspended member, so that the suspended member is rotatable about the second axle rod relative to the rotating body, and the carrier on the suspended member can sway along with the suspended member to always locate at a position perpendicular to the earth core.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
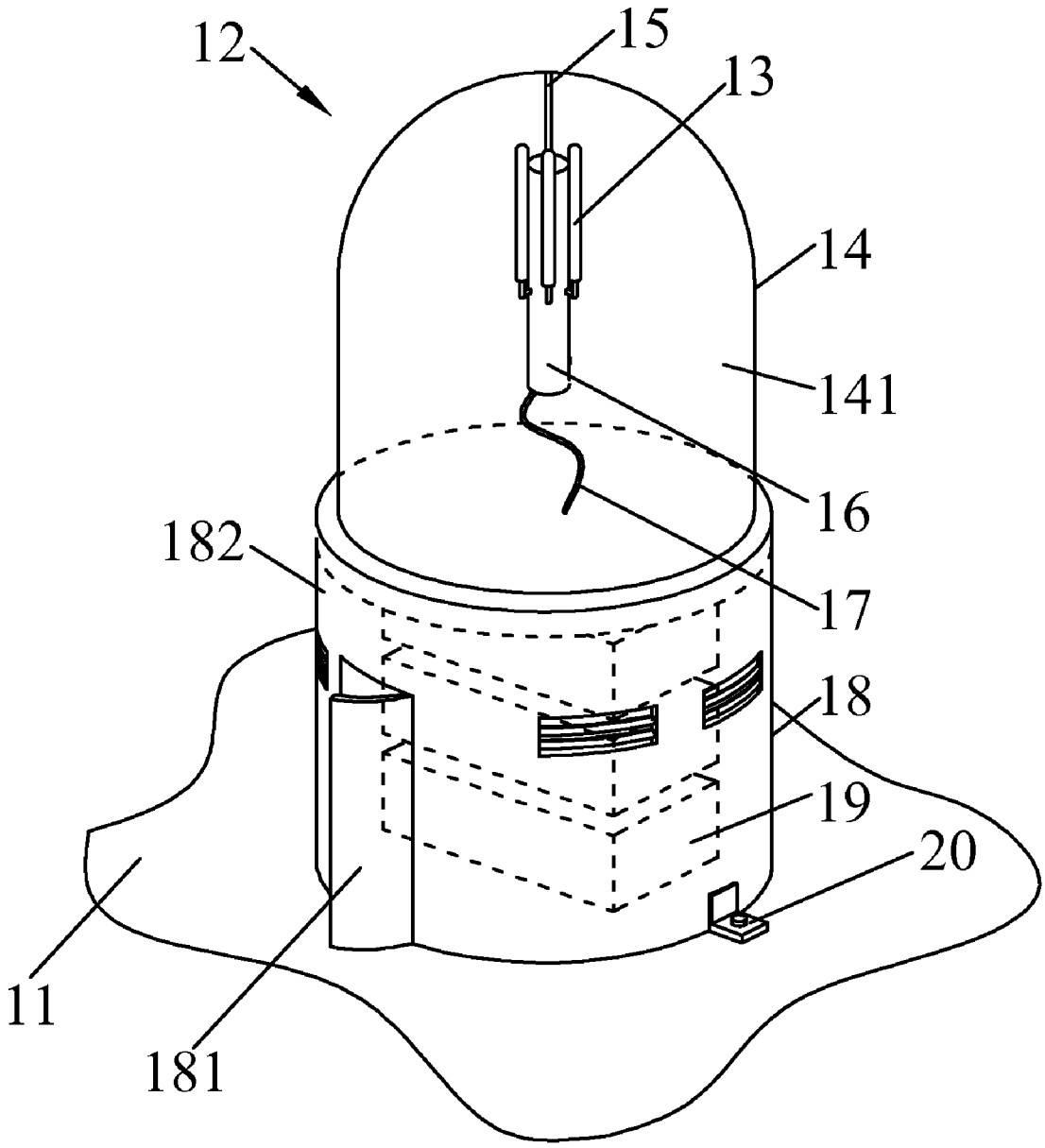
FIG. 1 is a perspective view schematically showing the structure of an antenna stabilizing apparatus according to a first embodiment of the present invention.

The present invention will now be described with some preferred embodiments thereof. For the purpose of easy to understand, elements that are the same in the preferred embodiments are denoted by the same reference numerals.

Please refer to FIG. 1 that is a perspective view schematically showing the structure of an antenna stabilizing apparatus 12 according to a first embodiment of the present invention. The antenna stabilizing apparatus 12 is designed for use on a marine vessel 11 to minimize the sway of an antenna 13 mounted on the marine vessel 11 when the marine vessel 11 rolls or pitches, so that the antenna 13 can have stable signal receiving and transmitting ranges. As shown in FIG. 1, the antenna stabilizing apparatus 12 comprises a housing 14, a hanging member 15, a carrier 16, a limiting member 17, and a base body 18. The base body 18 is fixedly mounted on the marine vessel 11. The housing 14 is mounted atop the base body 18 and internally defines a receiving space 141. In the illustrated first embodiment, the housing 14 is made of a rustproof material that does not interfere with the wireless signal transmission, such as a fiberglass material. The hanging member 15 is used to interconnect the housing 14 and the carrier 16 to each other. Depending on actual need, the hanging member 15 can be a length of rope. The carrier 16 is suspended in the receiving space 141 via the hanging member 15 to carry at least one antenna 13 thereon. The limiting member 17 interconnects the carrier 16 and a bottom of the housing 14 to each other, such that the carrier 16 is limited by the limiting member 17 to an allowable displacement range. The limiting member 17 can be a length of rope, depending on actual need.

The base body 18 is provided with a plurality of heat dissipating sections 182 and has at least one network device 19 received therein. Heat produced by the network device 19 during the operation thereof is dissipated via the heat dissipating sections 182 into external environment outside the base body 18. The base body 18 is provided at a lower end with a fixed section 20, via which the base body 18 is fixedly mounted to the marine vessel 11. Depending on actual condition, the fixed section 20 can be a matched loop and hook tape, snap fitting, or screw. The base body 18 is provided at one side with a door 181, via which an operator can install the network device 19 in the base body 18.

Figure 2:
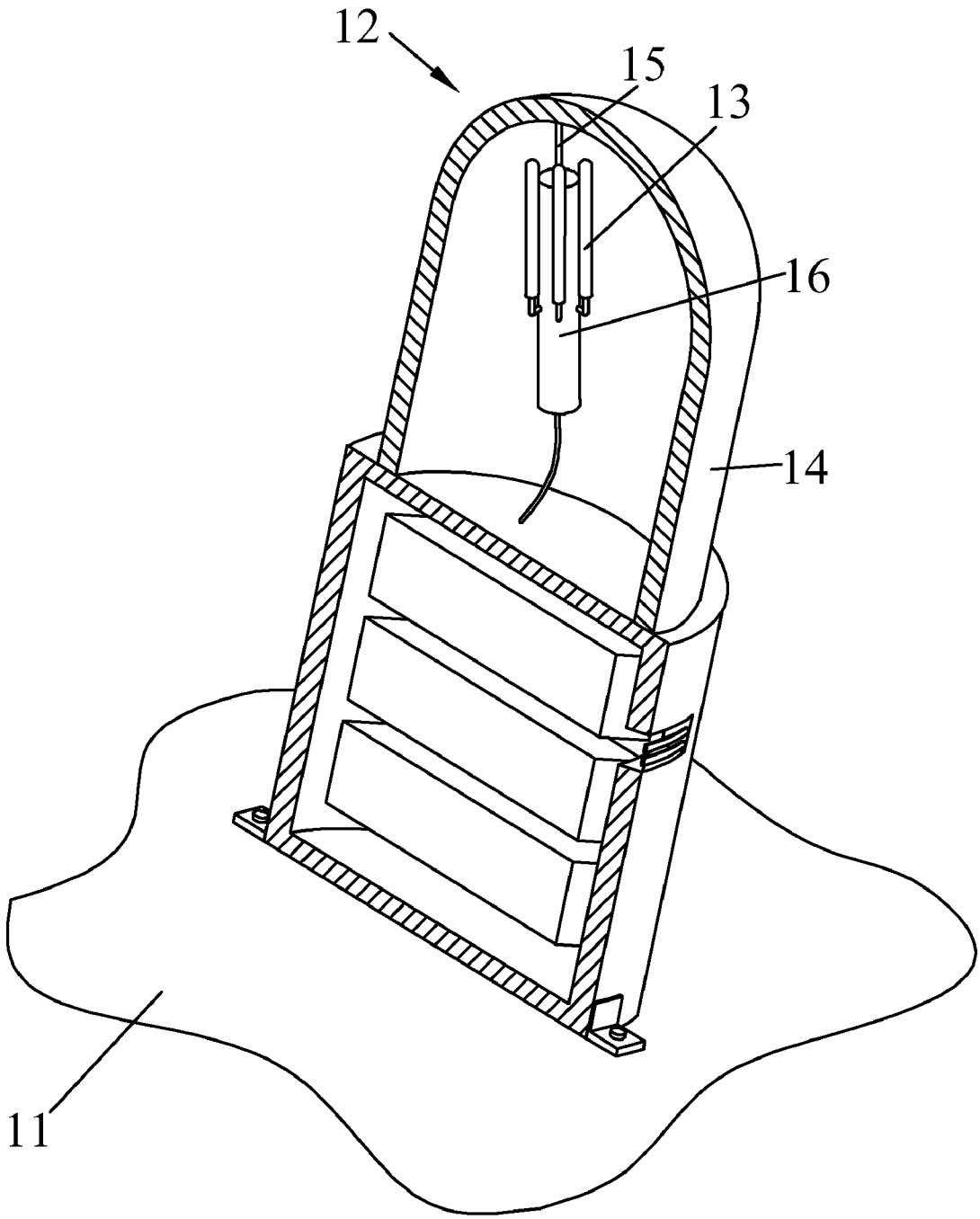
FIG. 2 is a cutaway perspective view showing the antenna stabilizing apparatus of FIG. 1 in a first tilted position.

FIG. 2 is a cutaway perspective view showing the antenna stabilizing apparatus 12 in a first tilted position. Since all the elements shown in FIG. 2 have been described with reference to FIG. 1, their structures and functions are not repeatedly explained herein. As shown, when the marine vessel 11 navigates the sea and is pushed by surges or strong wind to continuously roll or pitch, the base body 18 and the housing 14 of the antenna stabilizing device 12 are moved into a tilted position along with the marine vessel 11. However, the carrier 16 hung from the hanging member 15 is always perpendicular to the earth core, so that the antenna 13 mounted on the carrier 16 is always perpendicular to the earth core, too. With these arrangements, the antenna 13 can still have the widest and most stable wireless signal receiving and transmitting ranges without being adversely affected by the rolling and pitching marine vessel 11.

Meanwhile, being enclosed in the rustproof housing 14, the antenna 13 is protected against sunlight, rainwater, and corrosion by sea wind, so that the network device 19 and other precision instruments, communication apparatus and electronic devices on the marine vessel 11 are also protected against damage, short circuit, and other safety problems.

Figure 3:
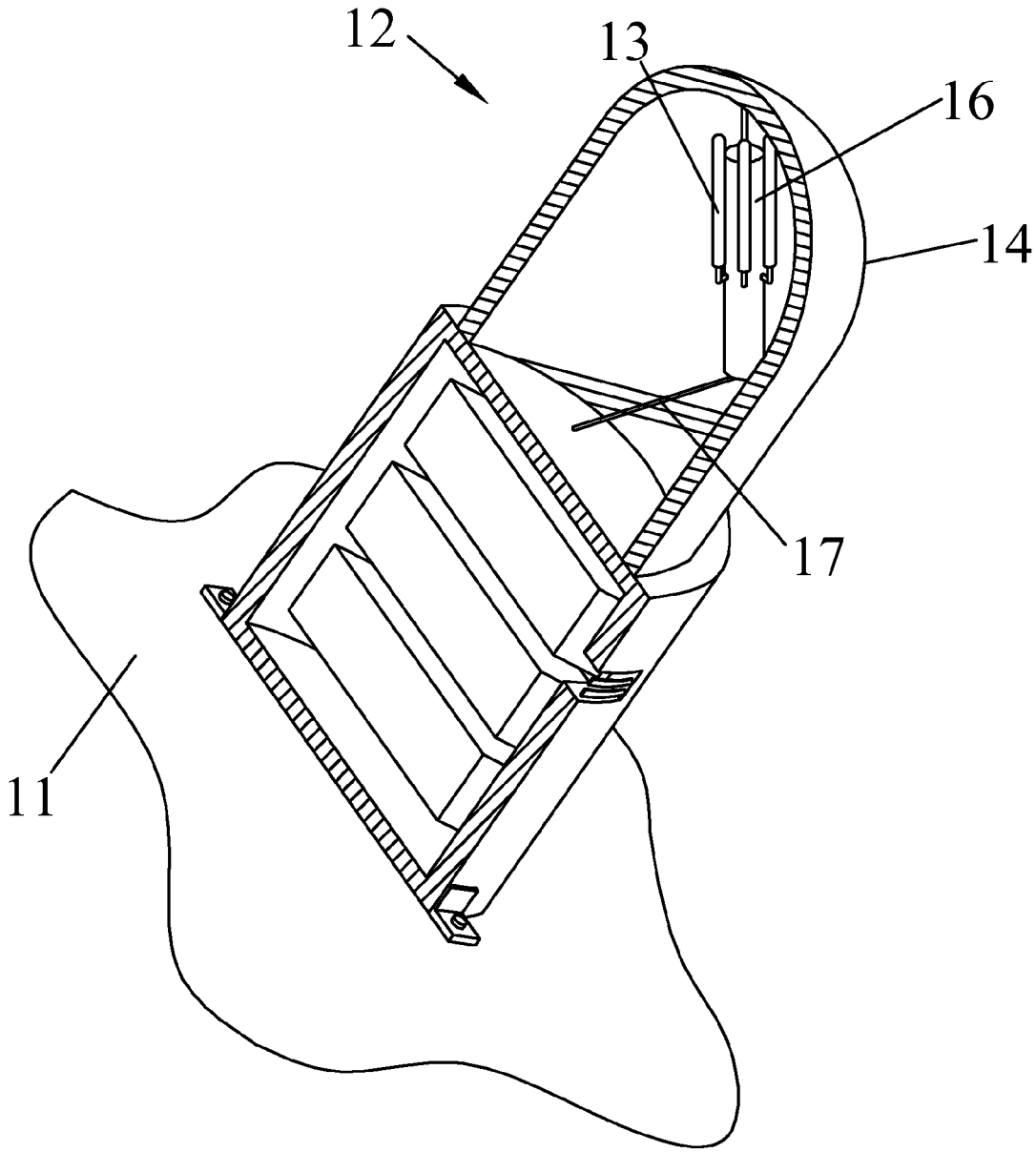
FIG. 3 is a cutaway perspective view showing the antenna stabilizing apparatus of FIG. 1 in a second tilted position.

FIG. 3 is a cutaway perspective view showing the antenna stabilizing apparatus 12 in a second tilted position. Since all the elements shown in FIG. 3 have been described with reference to FIG. 1, their structures and functions are not repeatedly explained herein. As shown, when the marine vessel 11 navigates the sea and is pushed by surges or strong wind to roll or pitch, and the base body 18 and the housing 14 of the antenna stabilizing device 12 are moved into an extremely tilted position along with the marine vessel 11, a lower end of the carrier 16 of the antenna stabilizing apparatus 12 tends to move closer to one side of the housing 14. At this point, the limiting member 17 is able to limit the range by which the lower end of the carrier 16 is allowed to approach one side of the housing 14, preventing the carrier 16 from colliding with the housing 14 and becoming damaged. That is, the antenna stabilizing apparatus 12 has the self-protective function without the risk of becoming damaged due to rolling and pitching of the marine vessel 11.

Figure 4:
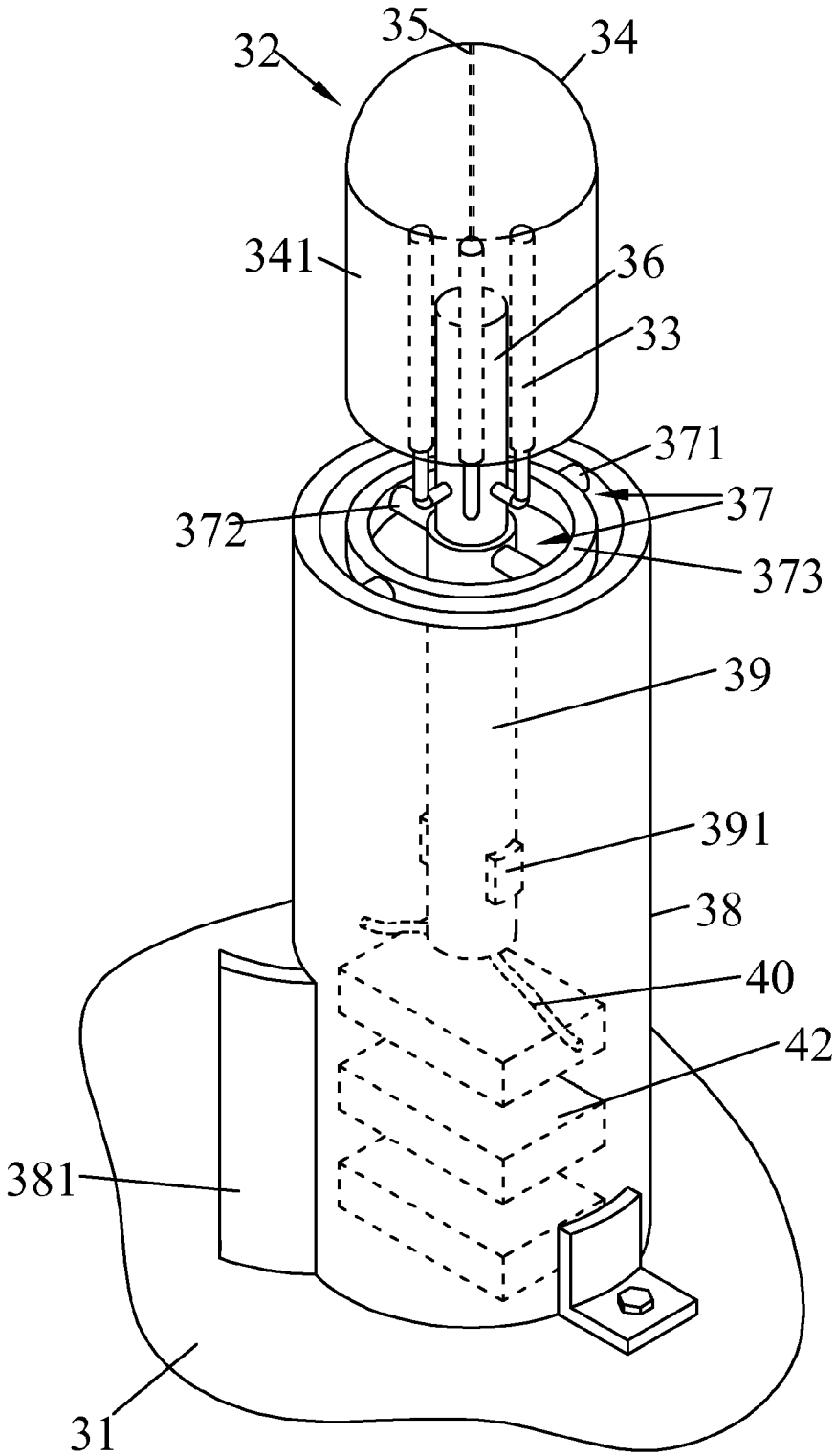
FIG. 4 is a perspective view schematically showing the structure of an antenna stabilizing apparatus according to a second embodiment of the present invention.

Please refer to FIG. 4 that is a perspective view schematically showing the structure of an antenna stabilizing apparatus 32 according to a second embodiment of the present invention. The antenna stabilizing apparatus 32 is designed for use on a marine vessel 31 to minimize the adverse influence of the rolling or pitching marine vessel 31 on an antenna 33 mounted thereon. As shown in FIG. 4, the antenna stabilizing apparatus 32 comprises a housing 34, a hanging member 35, a carrier 36, a supporting member 37, a base body 38, a suspended member 39, and a limiting member 40. The base body 38 is fixedly mounted on the marine vessel 31. The housing 34 is located over the base body 38 and internally defines a receiving space 341. In the illustrated second embodiment, the housing 34 is made of a rustproof material that does not interfere with the wireless signal transmission. The carrier 36 carries at least one antenna 33 thereon, and is located in the receiving space 341. The supporting member 37 is located below the carrier 36, and comprises a first axle rod 371, a second axle rod 372, and a rotating body 373. The rotating body 373 is rotatably located between the suspended member 39 and the base body 38, and is connected to the base body 38 via the first axle rod 371, such that the rotating body 373 is rotatable about the first axle rod 371 relative to the base body 38. The rotating body 373 is connected to the suspended member 39 via the second axle rod 372, such that the suspended member 39 is rotatable about the second axle rod 372 relative to the rotating body 373.

With the above arrangements, the carrier 36 can sway along with the suspended member 39 when the latter sways. The suspended member 39 is provided with at least one side cushion pad 391, so as to buffer an impact on the suspended member 39 and the base body 38 when the suspended member 39 sways and collides with the base body 38. The hanging member 35 is used to interconnect the housing 34 and the carrier 36 to each other for maintaining a fixed distance between the housing 34 and the carrier 36.

The base body 38 has at least one network device 42 received therein and comprises a door 381, via which an operator can install the network device 42 in the base body 38 or adjust the suspended member 39 or the supporting member 37. The limiting member 40 connects a lower end of the suspended member 39 to the marine vessel 31, such that the suspended member 39 is limited by the limiting member 40 to an allowable displacement range. The limiting member 40 can be a rope, depending on actual need.

Figure 5:
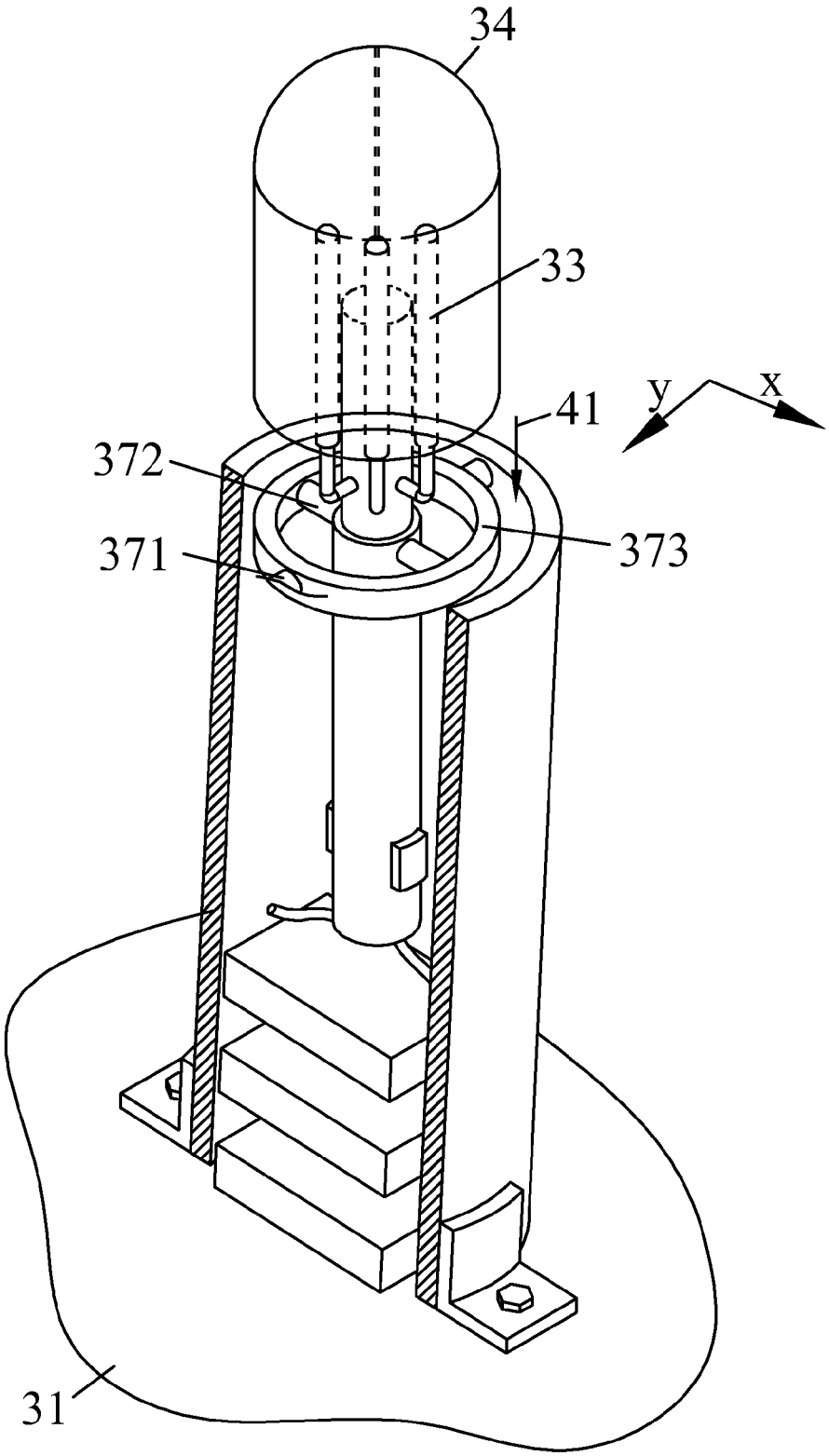
FIG. 5 is a cutaway perspective view showing the antenna stabilizing apparatus of FIG. 4 in a first tilted position.

FIG. 5 is a cutaway perspective view showing the antenna stabilizing apparatus 32 in a first tilted position. Since all the elements shown in FIG. 5 have been described with reference to FIG. 4, their structures and functions are not repeatedly explained herein. As shown, when the marine vessel 31 navigates the sea and is pushed by surges or strong wind to tilt in a first direction 41, the rotating body 373 can rotate about the first axle rod 371 to compensate the first direction 41 in x-direction; and meanwhile, the suspended member 39 can rotate about the second axle rod 372 to compensate the first direction 41 in y-direction. Therefore, the antenna 33 can always have signal receiving and transmitting ends perpendicular to the earth core, and the signal receiving and transmitting ranges of the antenna 33 are also always perpendicular to the earth core. That is, with the antenna stabilizing apparatus 32, the widest and most stable wireless signal receiving and transmitting ranges can still be obtained even when the marine vessel 31 is tilting on the sea.

Meanwhile, being enclosed in the rustproof housing 34, the antenna 33 is protected against sunlight, rainwater, and corrosion by sea wind to avoid short circuit and other safety problems of internal instruments mounted on the marine vessel 31.

Figure 6:
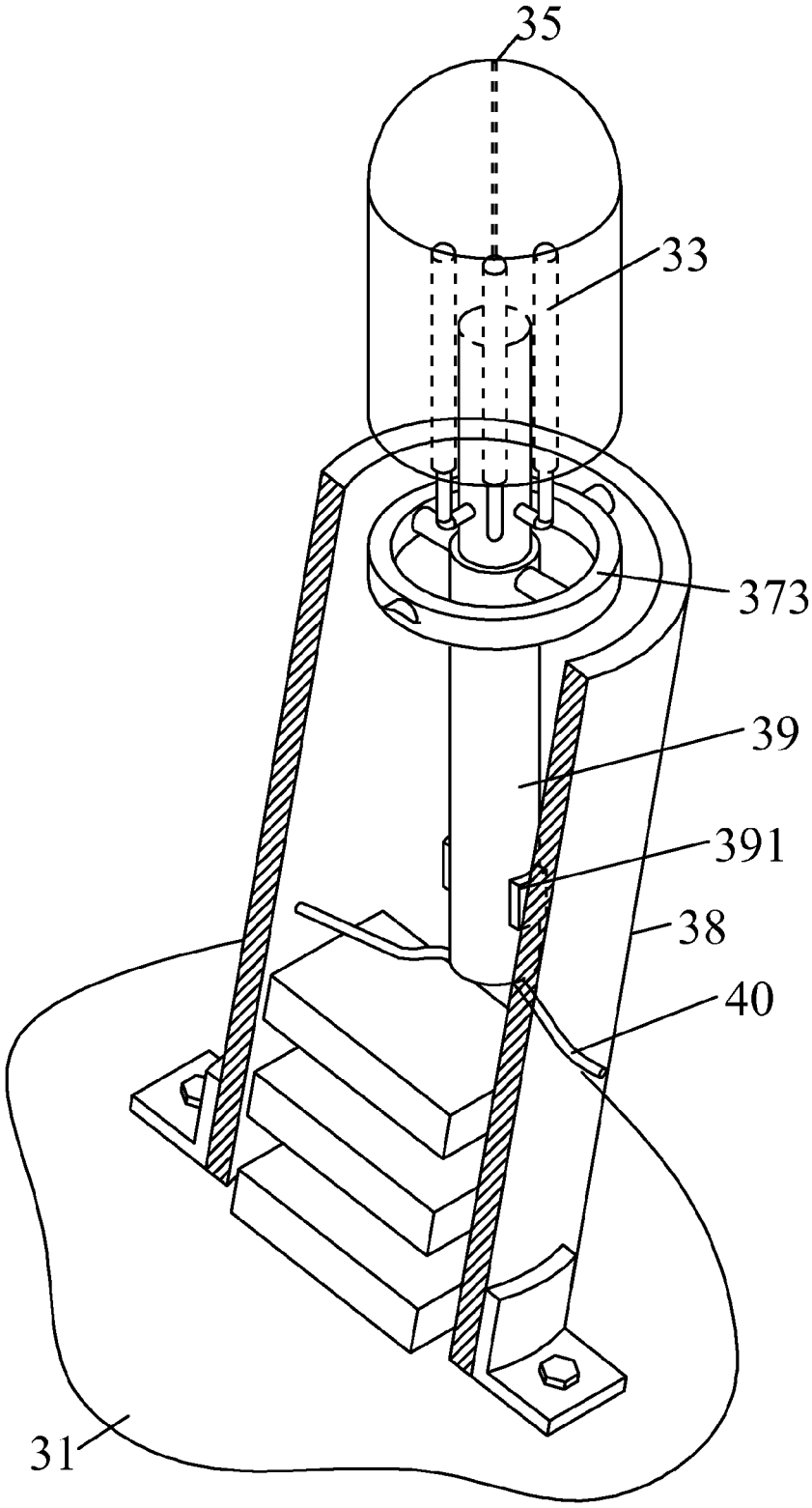
FIG. 6 is a cutaway perspective view showing the antenna stabilizing apparatus of FIG. 4 in a second tilted position.

FIG. 6 is a cutaway perspective view showing the antenna stabilizing apparatus 32 in a second tilted position. Since all the elements shown in FIG. 6 have been described with reference to FIG. 4, their structures and functions are not repeatedly explained herein. As shown, when the marine vessel 31 navigates the sea and is pushed by surges or strong wind to tilt at an increased angle, the lower end of the suspended member 39 tends to move closer to one side of the base body 38 to even collide with the base body 38 and cause damage of the antenna 33. At this point, the limiting member 40 is able to limit the range by which the lower end of the suspended member 39 is allowed to approach one side of the base body 38. That is, the antenna stabilizing apparatus 32 has the self-protective function to protect the suspended member 39 and accordingly the antenna 33 located thereabove from the risk of becoming damaged due to extremely tilting of the marine vessel 31. Even if the limiting member 40 is undesirably broken, the cushion pads 391 provided on the suspended member 39 can still buffer the force impacting on the suspended member 39 and the base body 38. Alternatively, the displacement range of the suspended member 39 and the antenna 33 can be limited by limiting the length of the hanging member 35, so as to avoid collision and damage of the antenna 33.

The present invention has been described with some preferred embodiments thereof and it is understood that many changes and modifications in the described embodiments can be carried out without departing from the scope and the spirit of the invention that is intended to be limited only by the appended claims.

What is claimed is:

1. An antenna stabilizing apparatus for use on a marine vessel, comprising:

a base body being mounted on the marine vessel;

a housing being mounted on a top of the base body and internally defining a receiving space;

a carrier having at least one antenna carried thereon and being suspended in the receiving space via a hanging member; and a limiting member interconnecting the carrier and a bottom of the housing to each other, so as to limit a displacement range of the carrier.

2. The antenna stabilizing apparatus as claimed in claim 1, wherein the base body has at least one network device received therein.

3. The antenna stabilizing apparatus as claimed in claim 1, wherein the base body is provided at a lower end with a fixed section, via which the base body is fixedly mounted on the marine vessel.

4. The antenna stabilizing apparatus as claimed in claim 3 wherein the fixed section is selected from the group consisting of a matched loop and hook tape, snap fitting, and screw.

5. The antenna stabilizing apparatus as claimed in claim 2, wherein the base body is provided with at least one heat dissipating section, via which heat produced by the at least one network device during the operation thereof is dissipated into external environment outside the base body.

6. The antenna stabilizing apparatus as claimed in claim 2, wherein the base body is provided on one side with a door, via which the at least one network device is able to operated by an operator.

7. The antenna stabilizing apparatus as claimed in claim 1, wherein the limiting member is a rope.

8. The antenna stabilizing apparatus as claimed in claim 1, wherein the hanging member is a rope.

9. The antenna stabilizing apparatus as claimed in claim 1, wherein the housing is made of a rustproof material that does not interfere with wireless signal transmission.

10. An antenna stabilizing apparatus for use on a marine vessel, comprising:

a base body being mounted on the marine vessel;

a housing being mounted on the base body and internally defining a receiving space;

a carrier having a plurality of antennas carried thereon and being located in the receiving space;

a supporting member being located below the carrier; a suspended member being swayable and connected to the carrier, the carrier being swayable along with the swaying suspended member; and a hanging member interconnecting the carrier and the housing to each other.

11. The antenna stabilizing apparatus as claimed in claim 10, wherein the base body further comprises a door, via which the suspended member or the supporting member is able to adjusted by an operator.

12. The antenna stabilizing apparatus as claimed in claim 10, wherein the supporting member comprises a rotating body, a first axle rod, a second axle rod; the rotating body being rotatably located between the suspended member and the base body, and connected to the base body via the first axle rod, such that the rotating body is rotatable about the first axle rod relative to the base body; and the rotating body being connected to the suspended member via the second axle rod, such that the suspended member is rotatable about the second axle rod relative to the rotating body.

13. The antenna stabilizing apparatus as claimed in claim 10, wherein the suspended member is provided with at least one side cushion pad to buffer an impact on the suspended member and the base body when the suspended member sways and collides with the base body.

14. The antenna stabilizing apparatus as claimed in claim 10, further comprising a limiting member for connecting the suspended member to the marine vessel, so as to limit an displacement range of the suspended member.

15. The antenna stabilizing apparatus as claimed in claim 14, wherein the limiting member is rope.

16. The antenna stabilizing apparatus as claimed in claim 10, wherein the housing is made of a rustproof material that does not interfere with wireless signal transmission.

17. An antenna stabilizing apparatus for use on a marine vessel, comprising:

a base body being mounted on the marine vessel;

a housing being mounted on the base body and internally defining a receiving space;

a carrier having a plurality of antennas carried thereon and being located in the receiving space;

a supporting member being located below the carrier; and a suspended member being swayable and connected to the carrier, the carrier being swayable along with the swaying suspended member;

wherein the base body further comprises a door, via which the suspended member or the supporting member is able to adjusted by an operator.

18. The antenna stabilizing apparatus as claimed in claim 17, wherein the supporting member comprises a rotating body, a first axle rod, a second axle rod; the rotating body being rotatably located between the suspended member and the base body, and connected to the base body via the first axle rod, such that the rotating body is rotatable about the first axle rod relative to the base body; and the rotating body being connected to the suspended member via the second axle rod, such that the suspended member is rotatable about the second axle rod relative to the rotating body.

19. The antenna stabilizing apparatus as claimed in claim 17, wherein the suspended member is provided with at least one side cushion pad to buffer an impact on the suspended member and the base body when the suspended member sways and collides with the base body.

20. The antenna stabilizing apparatus as claimed in claim 17, further comprising a limiting member for connecting the suspended member to the marine vessel, so as to limit an displacement range of the suspended member.

21. The antenna stabilizing apparatus as claimed in claim 20, wherein the limiting member is rope.

22. The antenna stabilizing apparatus as claimed in claim 17, wherein the housing is made of a rustproof material that does not interfere with wireless signal transmission.

23. An antenna stabilizing apparatus for use on a marine vessel, comprising:

a base body being mounted on the marine vessel;

a housing being mounted on the base body and internally defining a receiving space;

a carrier having a plurality of antennas carried thereon and being located in the receiving space;

a supporting member being located below the carrier; and a suspended member being swayable and connected to the carrier, the carrier being swayable along with the swaying suspended member;

wherein the supporting member comprises a rotating body, a first axle rod, a second axle rod; the rotating body being rotatably located between the suspended member and the base body, and connected to the base body via the first axle rod, such that the rotating body is rotatable about the first axle rod relative to the base body; and the rotating body being connected to the suspended member via the second axle rod, such that the suspended member is rotatable about the second axle rod relative to the rotating body.

24. The antenna stabilizing apparatus as claimed in claim 23, wherein the suspended member is provided with at least one side cushion pad to buffer an impact on the suspended member and the base body when the suspended member sways and collides with the base body.

25. he antenna stabilizing apparatus as claimed in claim 23, further comprising a limiting member for connecting the suspended member to the marine vessel, so as to limit an displacement range of the suspended member.

26. The antenna stabilizing apparatus as claimed in claim 25, wherein the limiting member is rope.

27. The antenna stabilizing apparatus as claimed in claim 23, wherein the housing is made of a rustproof material that does not interfere with wireless signal transmission.

28. An antenna stabilizing apparatus for use on a marine vessel, comprising:

a base body being mounted on the marine vessel;

a housing being mounted on the base body and internally defining a receiving space;

a carrier having a plurality of antennas carried thereon and being located in the receiving space;

a supporting member being located below the carrier; and a suspended member being swayable and connected to the carrier, the carrier being swayable along with the swaying suspended member;

wherein the suspended member is provided with at least one side cushion pad to buffer an impact on the suspended member and the base body when the suspended member sways and collides with the base body.

29. The antenna stabilizing apparatus as claimed in claim 28, further comprising a limiting member for connecting the suspended member to the marine vessel, so as to limit an displacement range of the suspended member.

30. The antenna stabilizing apparatus as claimed in claim 29, wherein the limiting member is rope.

31. An antenna stabilizing apparatus for use on a marine vessel, comprising:

a base body being mounted on the marine vessel;

a housing being mounted on the base body and internally defining a receiving space;

a carrier having a plurality of antennas carried thereon and being located in the receiving space;

a supporting member being located below the carrier;

a suspended member being swayable and connected to the carrier, the carrier being swayable along with the swaying suspended member; and a limiting member for connecting the suspended member to the marine vessel, so as to limit an displacement range of the suspended member.

32. The antenna stabilizing apparatus as claimed in claim 31, wherein the limiting member is rope.

* * * * *